United States Patent [19]

Allen

[11] 4,133,197

[45] Jan. 9, 1979

[54] ROLL-TYPE MACHINE FOR FORMING CYLINDRICAL SHEET METAL BODIES

[75] Inventor: Howard Allen, Stockton, Calif.

[73] Assignee: Carando Machine Works, Stockton, Calif.

[21] Appl. No.: 828,838

[22] Filed: Aug. 29, 1977

[51] Int. Cl.[2] ..... B21D 5/08

[52] U.S. Cl. ..... 72/15; 72/171; 72/175

[58] Field of Search ..... 72/166, 168–175, 72/14, 15

[56] References Cited

U.S. PATENT DOCUMENTS

| | | | |
|---|---|---|---|
| 2,742,078 | 4/1956 | Williams | 72/15 |
| 2,995,171 | 8/1961 | Hausler | 72/15 |

*Primary Examiner*—Milton S. Mehr

*Attorney, Agent, or Firm*—Roger B. Webster

[57] ABSTRACT

A roll-type machine for forming a cylindrical metal body from an initially flat sheet of metal; such cylindrical body being for use in the manufacture of tanks for air, gas, or water. The machine includes a forming roll which is mounted and controlled in a manner to automatically retract from its normal, fixed working position immediately prior to completion of formation of the cylindrical metal body whereby to prevent otherwise attendant out-of-round deformation of said body.

9 Claims, 5 Drawing Figures

1
2
3
4
5
6
7
8
9
10
11
12
13
14
15
16
17
18
19
20
22
23
24
25
28
29
30
32
34
35
36
37
42
43

ROLL-TYPE MACHINE FOR FORMING CYLINDRICAL SHEET METAL BODIES

BACKGROUND OF THE INVENTION

1. Field of the Invention

The present invention relates to a machine, of the type described, which embodies a suitably journaled, parallel axis, driven roll array including a large diameter primary roll, a small diameter pinch roll disposed closely adjacent but in spaced working relation to the face of the primary roll, and a small diameter bending or forming roll immediately beyond the pinch roll and also disposed closely adjacent but in spaced working relation to the face of said primary roll. All of such rolls are driven so that adjacent faces thereof turn in the same direction.

The initially flat sheet of metal is mechanically fed into the "pinch" point between the primary roll and pinch roll, and then—as advanced by the frictional drive produced at such "pinch" point—the sheet of metal engages the forming roll and thereby is progressively turned or bent downward with a resultant cylindrical curvature imparted to said sheet. This produces a cylindrical sheet metal body which extends about the primary cylinder and until the leading edge of such cylindrical body engages a stop which prevents such leading edge from being reengaged by said "pinch" point. At the same time, the bending roll must—as the essential concept of the instant invention—be retracted from working engagement with the trailing edge portion of the sheet in order to prevent undesirable deformation of the cylindrical, sheet metal body when its further motion about the primary roll is prevented by the stop. The present invention was conceived in a successful effort to implement such concept.

2. The Prior Art

U.S. Pat. Nos. 251,804; 1,354,951; 1,500,906; 2,140,404; 2,742,078; 2,995,171 and 3,279,229 are representative of the prior art known to applicant.

The above prior art—considered singly or together—does not anticipate, nor suggest as obvious, the particular structure of the herein-claimed driven roll array, including the retractable forming roll, and applicant has no knowledge of any prior art disclosing such particular structural arrangement.

SUMMARY OF THE INVENTION

The present invention provides—in a machine of the type described, and as a major object—a driven roll array including a forming roll, and a novel mount for effectively supporting said forming roll and automatically retracting the same from its normal, fixed working position to a non-working position at the time and for the purpose herein described.

The present invention provides, in a machine of the type described and as a further object, a driven roll array, including a normally fixed but retractable forming roll, which is designed for ready manufacture, and long use with a minimum of service and repair.

The present invention provides, in a machine of the type described and as a still further object, a practical and reliable driven roll array, including a normally fixed but retractable forming roll, which is exceedingly effective for the purpose for which it is designed.

DESCRIPTION OF THE PREFERRED EMBODIMENT

Figure 1:
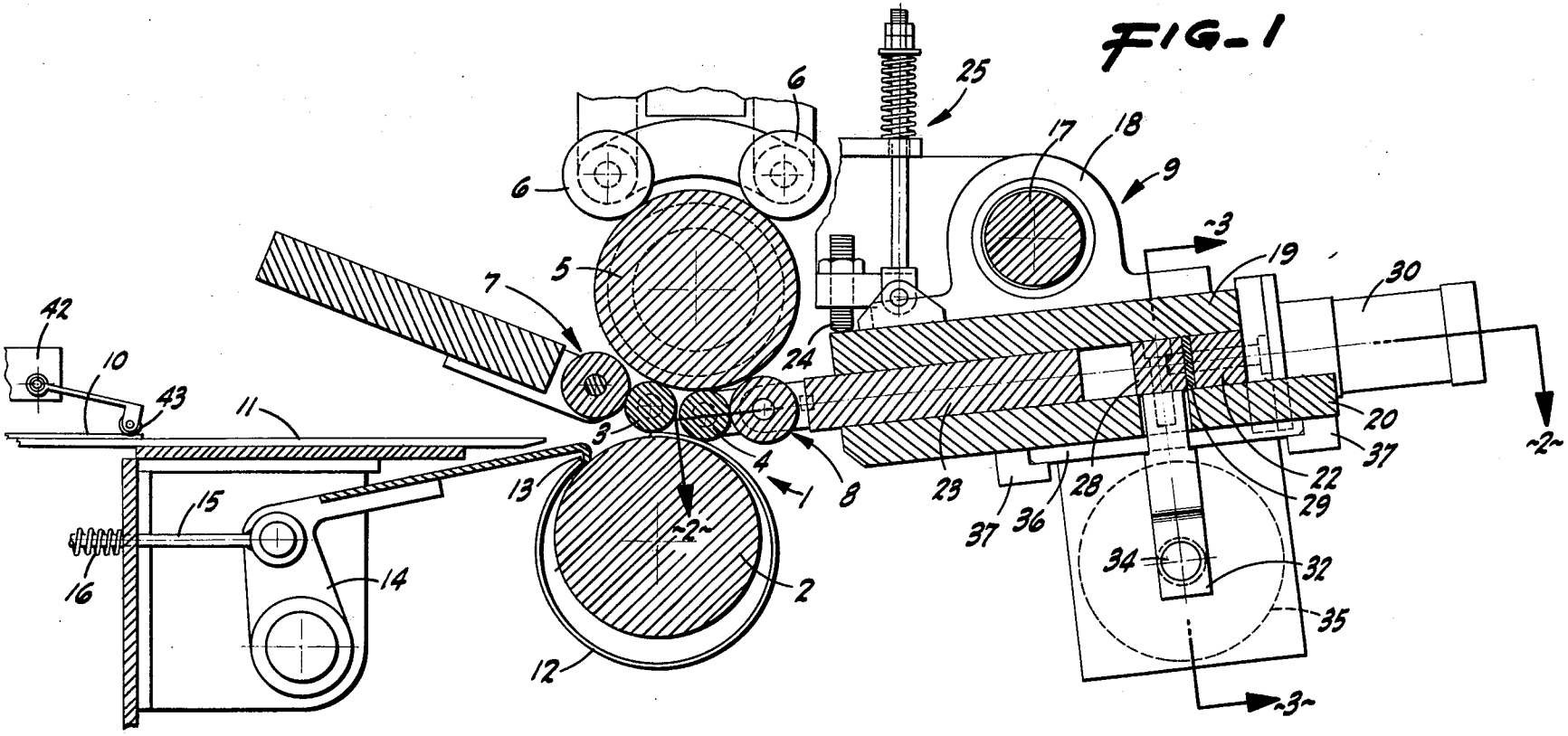
FIG. 1 is a longitudinal sectional elevation showing particularly the driven roll array, and the mount for the forming roll.
Figure 2:
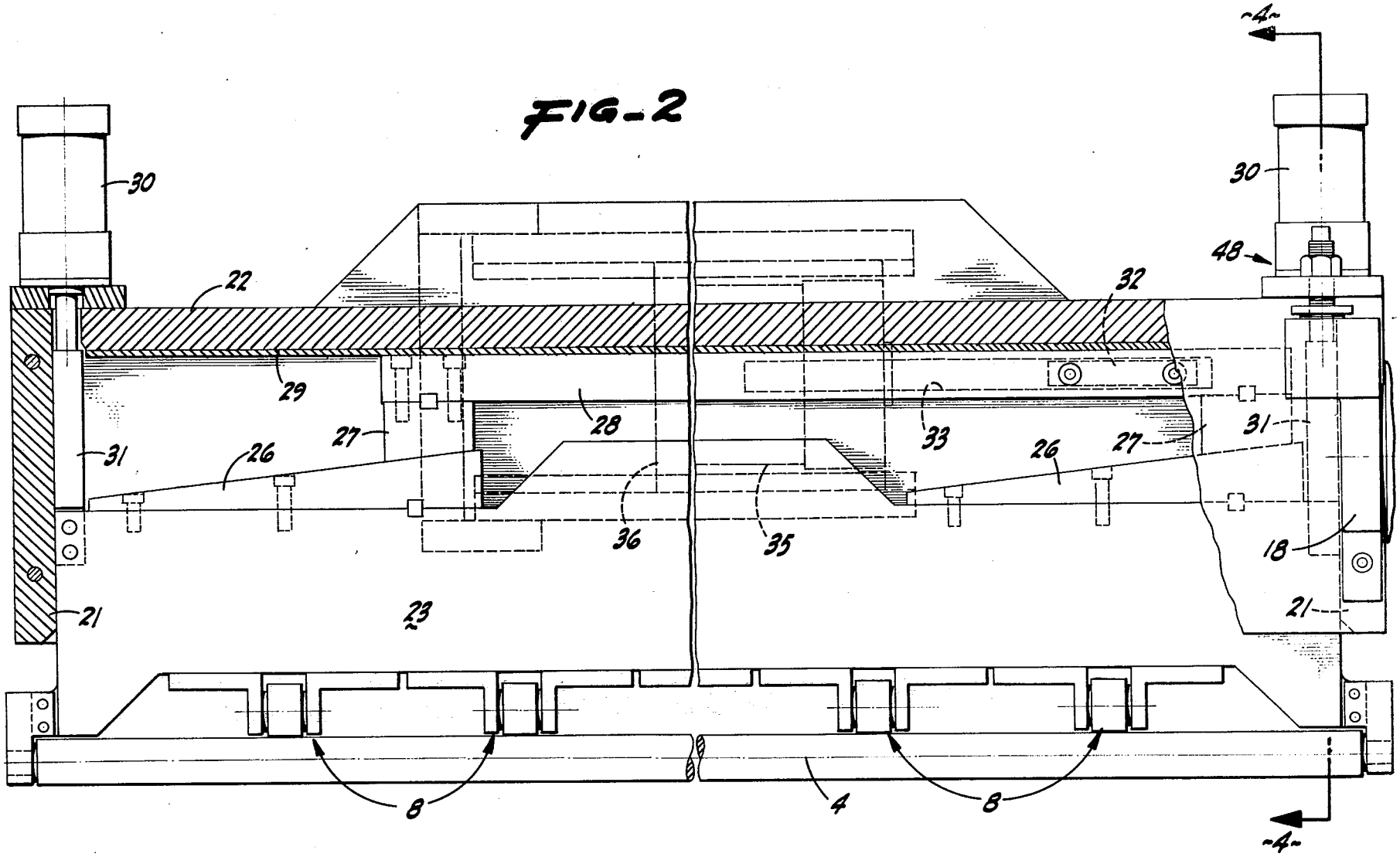
FIG. 2 is a fragmentary sectional plan taken substantially on line 2—2 of FIG. 1.
Figure 3:
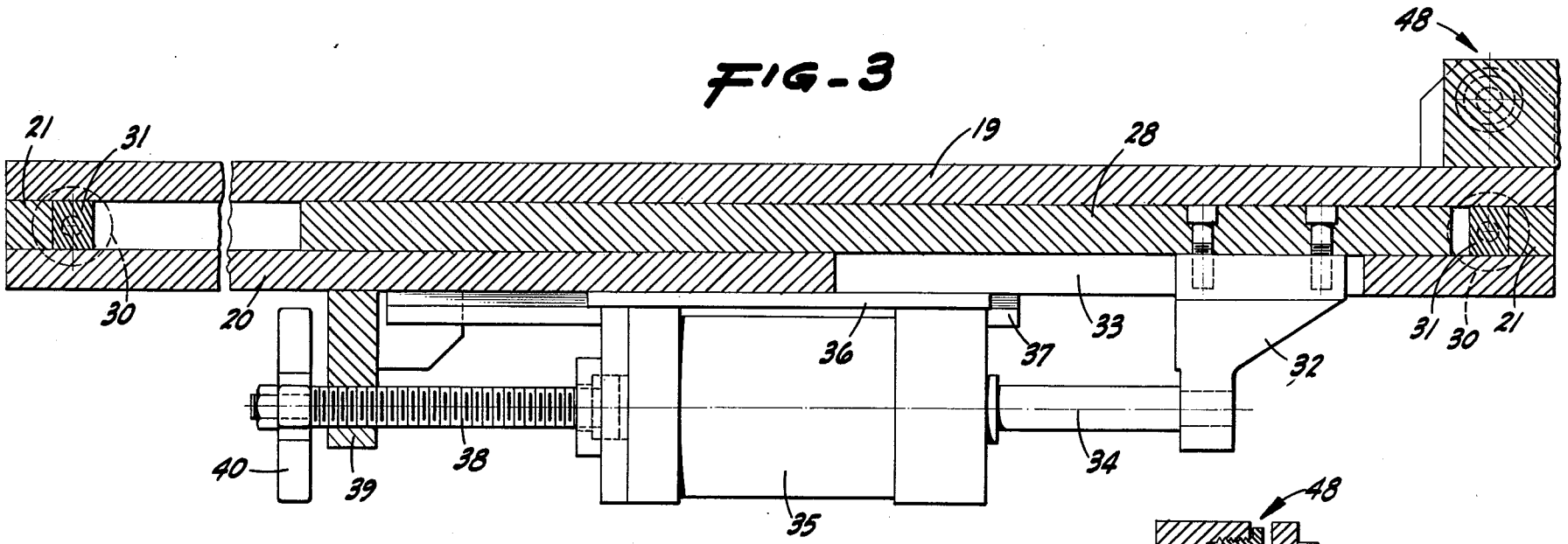
FIG. 3 is a transverse sectional elevation taken substantially on line 3—3 of FIG. 1.
Figure 4:
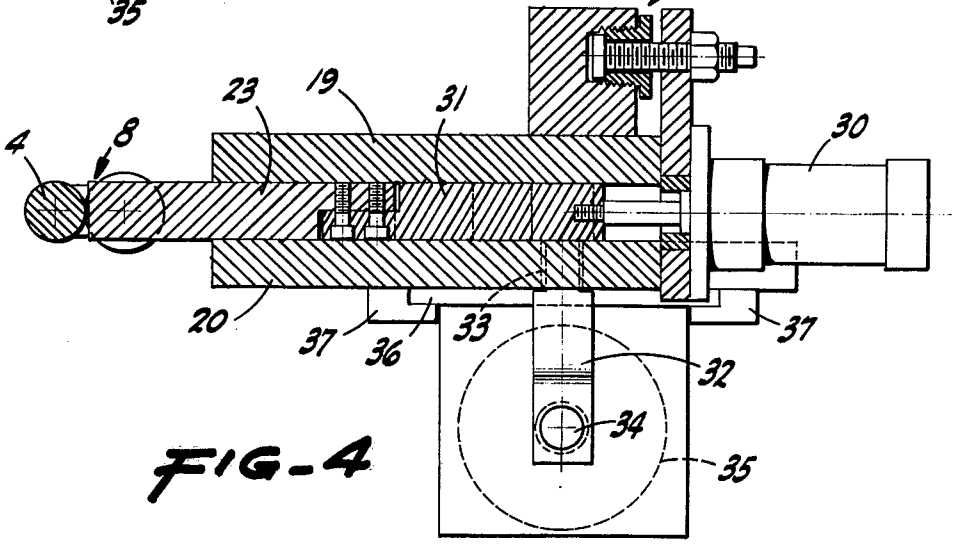
FIG. 4 is a cross sectional elevation taken substantially on line 4—4 of FIG. 2.

Referring now more particularly to the drawings and to the characters of reference marked thereon, the machine—which embodies the present invention and of the type described—includes, on an appropriate heavy-duty supporting frame (not shown), a suitably journaled, parallel axis, driven roll array indicated generally at 1; such roll array comprising the following:

A lower, relatively large diameter, primary roll 2 is driven, in the direction indicated, from a power source such as an electric motor (not shown); there being a relatively small diameter, pinch roll 3 disposed closely adjacent but in spaced working relation to the face of the primary roll 1 at the top thereof, and a relatively small diameter, bending or forming roll 4 immediately beyond the pinch roll 3 and also disposed closely adjacent but in spaced working relation to the face of said primary roll 2. The pinch roll 3 and forming roll 4 are engaged from above and driven by an upper, relatively large diameter roll 5 which—in turn—is driven, in the direction indicated, from a power source such as an electric motor. The upper roll 5 simultaneously drives the pinch roll 3 and forming roll 4 in the directions indicated, whereby the adjacent faces of rolls 1, 3, and 4 all turn in the same direction.

In addition to driving pinch roll 3 and forming roll 4, the upper roll 5 serves as a backing roll; and said roll 5 is—in turn—engaged from above by a set of anti-deflection rolls 6.

In clearance relation to the large lower roll 2 and the large upper roll 5, the pinch roll 3 is engaged by an anti-deflection backing roll assembly indicated generally at 7, while the forming roll 4 is engaged by an anti-deflection backing roll assembly indicated generally at 8. The pinch roll 3 remains fixed at all times in its working position, while the forming roll 4—which is normally fixed in working position—is carried by a mount, indicated generally at 9, whereby the forming roll 4 is retracted to a non-working position at the time and for the purpose later described.

In the operation of the machine, an initially flat sheet of metal, indicated at 10, is mechanically fed on a bed 11 until the leading edge of the sheet engages in the "pinch" point between primary roll 2 and pinch roll 3; the sheet then being advanced, by the frictional drive produced at such "pinch" point, into engagement with the forming roll 4 and thereby progressively turned or bent downward with a resultant cylindrical curvature imparted to said sheet. This produces a cylindrical sheet metal body 12 which extends about the primary roll 2 until the leading edge of said body engages and is stopped by a limited-travel, spring-resisted hook 13. The point at which the leading edge of body 12 is stopped by the hook 13 lies close to but short of the aforesaid "pinch" point; this preventing such leading edge from being undesirably re-engaged in said "pinch" point. The mount for the hook 13 includes a bellcrank lever 14, associated pull rod 15, and a spring 16 acting on such rod.

When the leading edge of body 12 comes to a stop by reason of engagement with the hook 13, the forming roll 4—which then lies adjacent but short of the trailing edge of the body 12—is quick-retracted. This is necessary for the reason that—with the leading edge of the body 12 stopped by the hook 13—continued driving by the forming roll of said body will cause an undesirable out-of-round deformation thereof intermediate its leading and trailing edges and—in the main—in the bottom zone thereof. However, as the forming roll 4 then occupies a position very close to the trailing edge of body 12, retraction of such forming roll—at the time described—does not materially affect the cylindrical formation of said body.

The mount 9 for the forming roll 4—and which mount embodies the main instrumentalities for automatic and quick retraction of said forming roll—is constructed and functions as follows:

A frame-mounted cross shaft 17 supports a bearing 18 which rests on and is secured to a rectangular top plate 19 disposed in adjacent but spaced relation above a rectangular bottom plate 20; such plates being fixed together, and spaced in parallelism, by side bars 21 and a transverse rear bar 22. The spaced-apart top plate 19 and bottom plate 20 define a carrier for, and receive in guided relation therebetween, a rectangular slide 23 which projects beyond the inner or front end of the mount 9; such slide 23 being guided by the side bars 21. At its front and exposed end, the slide 23 carries, in transversely extending journaled relation, the forming roll 4 and—rearwardly thereof—the backing roll assembly 8.

The slide 23, and the related plates 19 and 20 (all as included in mount 9) occupy a plane which extends substantially tangentially away from the top of the primary roll 2 and as necessary to dispose the forming roll 4 in proper working position. Such working position of the forming roll is pre-set by an adjustable stop 24 which abuts the top plate 19 from above and against upward thrust applied thereto by a spring unit 25; i.e., the spring unit 25 tends to rotate bearing 18 and holds said top plate 19 in abutment with said stop 24.

The slide 23 is normally held in a position with the forming roll 4 advanced in working position, but is quick-retractable (for the reason before described) by means of the following mechanism:

A pair of like tapered cams 26, disposed between plates 19 and 20, are secured in transversely spaced relation on the inner edge of the slide 23, and each such cam is normally held in an advanced position by a cooperating, mating, shiftable cam follower block 27 on a transversely movable shifting bar 28 likewise disposed between said plates 19 and 20; there being a wear strip between the shifting bar 28 and rear bar 22.

Upon fast shifting (as hereinafter described) of the bar 28 in a direction to cause the cam follower blocks 27 to "descend" or slide downward on the cams 26, the slide 23, together with the forming roll 4, is quick-retracted whereby to move said forming roll 4 out of its working position and clear of the formed body 12. Such quick-retraction of slide 23 is caused by a pair of always-energized air cylinders 30 mounted at the rear corners of mount 9 and connected to said slide 23 by members 31. When the cam follower blocks 27 slide down the cams 26, the air cylinders 30 simultaneously act to pull the slide rearward a distance sufficient to retract the forming roll 4 from its working position.

Fast shifting of bar 28, as above, is accomplished as follows:

A bracket 32 is fixed on bar 28 and extends downward through a transversely elongated slot 33 in bottom plate 20; such bracket 32 depending a distance below said bottom plate, and there being attached to the piston rod 34 of a transverse-axis, double-acting, fluid-pressure-actuated, power cylinder 35 suspended from a transversely slidable header 36 carried in guides 37 on the underside of bottom plate 20. The power cylinder 35 is axially adjustable to properly position the shifting bar 28 and cam follower blocks 27 in their initial or normal position; such axial adjustment of power cylinder 35 being attained by means of a threaded rod 38 which extends in rotatable relation from such power cylinder at the end opposite the piston rod 34, and thence is threaded through a fixed bracket 39 and provided therebeyond with a hand wheel 40.

With the above arrangement, actuation of the power cylinder 35 in one direction fast-shifts bar 28 in a corresponding direction with resultant quick-retraction—as before described—of the forming roll 4. Subsequent and reverse actuation of said power cylinder returns the parts to starting position and with the forming roll 4 advanced to working position and preparatory to forming the next cylindrical body 12.

Figure 5:
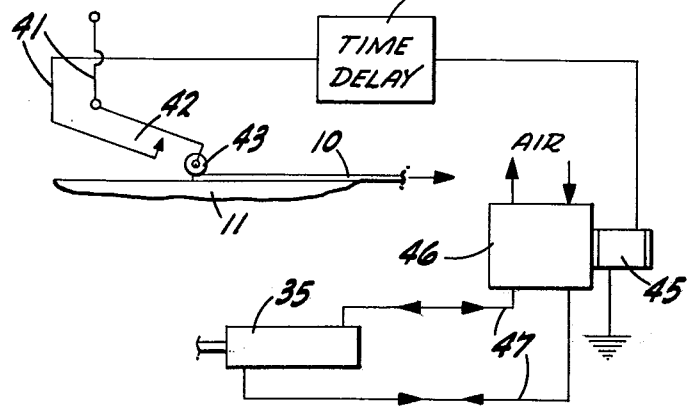
FIG. 5 is a diagrammatic illustration of the control circuit.

The power cylinder 35 is actuated, to cause quick-retraction of forming roll 4 and at the proper time, by means of a suitable control system indicated in outline and in an exemplary manner in FIG. 5; such system including the following:

A circuit 41 is closed by a switch 42 when a sensing roller 43 drops—at a predetermined point—off the trailing edge of each initially flat, metal sheet 10 being fed to the roll array; the so-closed circuit then—after a time lapse determined by a time delay relay 44—energizing a solenoid 45 which works a reversible valve 46 which—in turn—controls the fluid pressure flow in conduits 47 leading to the power cylinder 35. The sequencing is such that the power cylinder 35 is actuated to cause retraction of forming roll 4 at the precise time previously described.

Upon the leading edge of each following metal sheet 10 engaging roller 43 and opening switch 42, the control circuit is reversed and its parts return to normal or initial positions.

An adjustment unit, indicated generally at 48, is employed for the purpose of pre-setting the mount 9 (relative to its suspension bearing 18) in a position disposing the axis of forming roll 4 exactly parallel to the axis of primary roll 2.

From the foregoing description, it will be readily seen that there has been produced, in a machine of the type described, a driven roll array, including a normally fixed but retractable forming roll, as substantially fulfills the objects of the invention, as set forth herein.

While this specification sets forth in detail the present and preferred construction, in a machine of the type described, of the driven roll array, including the normally fixed but retractable forming roll, still in practice such deviations from such detail may be resorted to as do not form a departure from the spirit of the invention as defined by the appended claims.

I claim:

1. In a roll-type machine, for forming a cylindrical body from an initially flat sheet of metal, a parallel axis, roll array including a driven primary roll, a driven pinch roll disposed closely adjacent but in spaced working relation to the face of the primary roll, and a driven forming roll in a predetermined position relative to and immediately beyond the pinch roll and disposed closely adjacent but in spaced working relation to said face of said primary roll, all said rolls being driven with the adjacent faces thereof turning in the same direction; means mounting the forming roll in a normally fixed working position but retractable to a non-working position, and means operative to cause such retraction of the forming roll; the initially flat sheet of metal being fed to the pinch point between the primary roll and the pinch roll, and thence advanced by said primary and pinch rolls to engagement with the forming roll and thereby progressively bent as a cylindrical body extending about the primary cylinder; and the means to cause such retraction of the forming roll being actuated in response to a predetermined feeding position of the sheet of metal.

2. A machine, as in claim 1, in which the forming-roll-mounting means includes a slide, the forming roll being journaled on the slide, a guide structure supporting the slide for motion in a direction to retract the forming roll from working position to nonworking position, and a releasable mechanism on the guide structure normally holding the slide with the forming roll in said working position; and the means to cause retraction of the forming roll including an instrumentality operative to cause release of said holding mechanism, and a power device connected between the guide structure and the slide operative, upon release of said mechanism, to move the slide in said retracting direction.

3. A machine, as in claim 2, in which said releasable holding mechanism includes a shifting member on the guide structure, and a cam assembly in part on the slide and in part on the shifting member; predetermined shifting motion of said member acting on the cam assembly to cause release of the slide for motion in such retracting direction; and said instrumentality comprising a separate power device, connected between the guide structure and the shifting member, operative to impart such predetermined shifting motion to said member.

4. A machine, as in claim 3, in which the power device connected between the guide structure and the slide, and the separate power device connected between the guide structure and the shifting member, each include at least one fluid-pressure-actuated power cylinder.

5. A machine, as in claim 3, in which the shifting member is disposed transversely in adjacent but spaced relation to an end of the slide opposite from the forming roll; the cam assembly including at least one tapered cam on the slide, and a matching tapered cam follower block on the shifting member.

6. A machine, as in claim 1, in which the forming-roll-mounting means includes a slide, the forming roll being journaled on a forward end of the slide, a guide structure supporting the slide generally tangentially relative to the primary roll and for outward motion in a direction to retract the forming roll from working position to non-working position, the guide structure including a top plate and a bottom plate in adjacent but spaced parallel relation, the slide being disposed between such top and bottom plates with said forward end of the slide extending therebeyond, and a releasable mechanism on the guide structure in part between said plates normally holding the slide with the forming roll in said working position; the means to cause retraction of the forming roll including an instrumentality operative to release holding mechanism; and a power device connected between the guide structure and the slide operative, upon release of said mechanism, to move the slide in said retracting direction.

7. A machine, as in claim 6, in which said releasable holding mechanism includes a shifting bar disposed transversely between said plates adjacent but spaced from the rear end of the slide, and a cam assembly in part on the rear end of the slide and in part on the shifting bar, predetermined shifting motion of such bar acting on the cam assembly to cause release of the slide for motion in such retracting direction; and said instrumentality being a separate power device, connected between the guide structure and the shifting member, operative to impart such predetermined shifting motion to said bar.

8. A machine, as in claim 7, in which said separate power device is a fluid-pressure-actuated power cylinder mounted in connection with and disposed below the bottom plate, the axis of said power cylinder being parallel to the shifting bar, a bracket depending from the shifting bar, the bottom plate having a transverse slot through which the bracket depends, and the power cylinder being connected to the bracket and operative thereby to impart such predetermined shifting motion to the bar.

9. A machine, as in claim 1, in which the forming-roll-mounting means includes a slide, the forming roll being journaled on a forward end of the slide, a guide structure supporting the slide generally tangentially relative to the primary roll and for outward motion in a direction to retract the forming roll from working position to non-working position, the guide structure including a top plate and a bottom plate in adjacent but spaced parallel relation, the slide being disposed between such top and bottom plates with said forward end of the slide extending therebeyond, and a releasable mechanism on the guide structure in part between said plates normally holding the slide with the forming roll in said working position; and the means to cause retraction of the forming roll including an instrumentality operative to release said holding mechanism; and power means connected between the guide structure and the slide operative, upon release of said mechanism, to move the slide in said retracting direction; said power means comprising a pair of transversely spaced, fluid-pressure-actuated power cylinders mounted on the guide structure rearwardly of the slide, said power cylinders having axes extending in the direction of slide motion, and means between said plates connecting such power cylinders to the rear of the slide at transversely spaced points.

* * * * *